US005230121A

United States Patent [19]

Blackman

[11] Patent Number: 5,230,121

[45] Date of Patent: Jul. 27, 1993

[54] SINGLE MOTOR UPRIGHT VACUUM CLEANER

[75] Inventor: Gordon R. Blackman, Lexington; Ky.

[73] Assignee: Matsushita Floor Care Company, Danville, Ky.

[21] Appl. No.: 865,364

[22] Filed: Apr. 8, 1992

[51] Int. Cl.[5] ..... A47L 5/30

[52] U.S. Cl. ..... 15/410; 15/351; 15/412

[58] Field of Search ..... 15/410, 351, 412

[56] References Cited

U.S. PATENT DOCUMENTS

| | | | |
|---|---|---|---|
| 2,165,678 | 7/1939 | Riebel et al. | 15/351 |
| 2,677,850 | 5/1954 | Brace . | |
| 3,199,138 | 8/1965 | Nordeen . | |
| 3,654,661 | 4/1972 | Scott . | |
| 3,763,635 | 10/1973 | Schmitz | 15/351 X |
| 4,182,618 | 1/1980 | Tschudy | 15/351 X |
| 4,349,361 | 9/1982 | Scott et al. . | |
| 4,566,884 | 1/1986 | Jones et al. . | |
| 4,623,811 | 11/1986 | Nystuen et al. | 15/412 X |
| 4,996,737 | 3/1991 | Madru | 15/366 |
| 5,007,133 | 4/1991 | Lackner et al. . | |

OTHER PUBLICATIONS

Commercial product sold under the trademark Hoover Elite II.

*Primary Examiner*—Chris K. Moore

*Attorney, Agent, or Firm*—Amster, Rothstein & Ebenstein

[57] ABSTRACT

An upright vacuum cleaner having a nozzle assembly including a blower motor and agitator brush and a handle assembly rotatably mounted thereto. The handle rotates relative to the nozzle assembly while the blower motor remains fixed thereto. The vacuum cleaner includes height adjusting means for changing the height of the agitator brush relative to the floor surface which, although manually adjustable, once adjusted retains its adjustment. Improved, self-locking latches are provided on the bottom of the nozzle assembly for maintaining a cover affixed to the nozzle assembly. In order to release the self-locking latches, a release member must be actuated at the same time the latch is opened. The vacuum cleaner includes top and bottom bag retaining assemblies which are simple in construction and can be assembled without the use of tools.

11 Claims, 12 Drawing Sheets

SINGLE MOTOR UPRIGHT VACUUM CLEANER

BRIEF DESCRIPTION OF THE INVENTION

The present invention relates generally to vacuum cleaners and more particularly to a novel and improved single motor upright vacuum cleaner of the type having a handle assembly and a nozzle assembly containing a blower assembly with a blower motor which both provides suction at a nozzle at the front of the nozzle assembly and turns an agitator brush. A flexible dust bag is attached to the nozzle assembly for collecting dust and particulate matter drawn into the vacuum cleaner by the blower assembly.

The present invention is directed to a vacuum cleaner construction wherein the handle assembly is attached to the blower assembly and rotates relative to the nozzle assembly about the blower motor of the blower assembly while the blower motor is fixedly mounted to the nozzle assembly. The vacuum cleaner of the present invention also has a flexible dust bag attached to the handle assembly utilizing an improved clamping arrangement. The nozzle assembly of the improved vacuum cleaner also incorporates a novel mechanism for adjusting the height of such assembly, which contains the rotary agitator brush, relative to the floor surface being cleaned. The agitator brush is rotated by the blower motor through a belt and pulley arrangement. There is a cover secured to the underside of the nozzle assembly housing which shields the rotating parts. The vacuum cleaner incorporates an improved latch mechanism which provides a positive lock that prevents the cover from being inadvertently opened and is childproof as well.

BACKGROUND OF THE INVENTION

Single motor upright vacuum cleaners are well-known in the art. Such upright vacuum cleaners typically have a nozzle assembly which contains the blower motor, a rotating agitator brush and a suction nozzle opening adjacent the brush. The suction is created by an impeller or suction fan turned by the blower motor and mounted within an impeller housing. As the blower motor turns, a negative pressure or suction is created which is delivered to the suction nozzle opening by a vacuum plenum in the nozzle housing. Conventionally, the suction at the nozzle opening causes dust and particulate matter to flow from the agitator brush, through the vacuum plenum to the impeller housing and thereafter to the dust bag where it is collected.

Typically, in an upright vacuum cleaner the dust bag is flexible and can be mounted on the outside of the handle assembly. In order to use the vacuum cleaner comfortably, the handle assembly must rotate relative to the nozzle assembly. Thus, it is necessary to provide a means by which the connection of the dust bag to the nozzle assembly can accommodate this rotation. Early upright vacuum cleaners such as that shown in U.S. Pat. No. 1,235,920, rigidly connect the opening of the flexible dust bag directly to the output of the impeller housing of the nozzle assembly. The flexibility of the dust bag allows the handle assembly to rotate relative to the nozzle assembly. However, when the blower motor is turned on, the dust bag inflates becoming less flexible and making it difficult to rotate the handle assembly relative to the nozzle assembly thereby placing undue stress on the dust bag in the area of its connection to the impeller housing, potentially causing premature failure of the dust bag.

Later, vacuum cleaners utilized blower motors mounted to the nozzle assembly and a flexible conduit between the output of the impeller housing and the open end of the dust bag. Such arrangements have the disadvantage of requiring a flexible coupling which is susceptible to wear and ultimately leaking pressurized air containing dust and other particulate matter.

More recently, in order to provide a more durable seal between the dust bag and the output of the impeller housing, upright vacuum cleaners have incorporated handle assembles with a central conduit rigidly mounted to the output of the impeller housing of the blower at one end, and to the dust bag at the other. In order to allow rotation of the handle assembly, the blower motor is rotatably mounted within the nozzle assembly so that rotation of the handle assembly and the associated central conduit relative to the nozzle assembly causes the blower motor and integral impeller housing to rotate as well. The disadvantage of such arrangement is that the wiring to the blower motor is caused to flex each time the handle assembly is rotated, contributing to chafing and early failure of the electrical wiring.

U.S. Pat. No. 3,199,138 discloses an upright vacuum cleaner construction in which the handle assembly has a central conduit which is fixedly mounted to the output of the impeller housing. The impeller housing is mounted to the blower motor in a manner which allows relative rotation of the impeller housing and handle assembly to the blower motor while the blower motor remains fixedly mounted within the nozzle assembly. However, the disadvantage of such construction is that in order to centrally mount the handle assembly to the nozzle assembly, the blower motor is mounted remotely from the center line of the nozzle assembly Thus, when the vacuum cleaner is pushed and pulled over the floor, there is a substantial torque created about the handle axis making it less comfortable to use the vacuum cleaner.

Moreover, the blower assembly taught by U.S. Pat. No. 3,199,138 does not include integral side walls which rotate with the assembly. Rather, the annular bearings which permit rotation of the assembly housing incorporate relatively large diameter sealing elements. These sealing elements diminish the strength of the bearings because of their inherent flexibility and may be prone to leakage if the handle assembly is moved obliquely to its axis of rotation, which would likely occur while manipulating the vacuum cleaner during operation.

Upright vacuum cleaners utilizing flexible dust bags must have mounting means for such dust bags which will accommodate shortening of the dust bag as the bag is caused to inflate by the air passing through the impeller housing. An early mounting means construction is disclosed in U.S. Pat. No. 1,235,920. More recent constructions include a bag hanger having opposed bag supporting arms inserted into cavities formed by the side pleats of a flexible dust bag stitched closed at the top as taught by U.S. Pat. No. 4,349,361. Therein, the bag hanger is secured to a rigid bar casing which serves to cover both the top portion of the bag and to anchor a hook shaped wire for connection to the handle assembly. Similarly, U.S. Pat. No. 4,566,884 discloses an upper bag retainer system wherein the flexible dust bag is secured between a bag support plate and a bag cover. U.S. Pat. No. 5,007,133 discloses an upper bag retainer system wherein the bag is stitched closed at its top with several cloth loops stitched into the top portion. A mounting bar is inserted through the loops for connection to the handle assembly. Each of these devices has the disadvantage of being comprised of numerous parts and results in increased costs to produce due to the need for substantial assembly or installation or the additional operation of stitching loops to the top of the dust bag.

An upright vacuum cleaner having a rotating brush mounted within the nozzle assembly requires a means to adjust the height of the nozzle assembly and rotating brush to account for variations in the height of floor coverings so that the vacuum cleaner will effectively remove dust and particulate matter from low pile carpeting such as indoor/outdoor carpeting and high pile or deep shag type carpeting. Such devices are well-known. For example, the adjusting device taught by U.S. Pat. No. 2,677,850 incorporates a lever which adjusts the height of the nozzle assembly and U.S. Pat. No. 3,654,661 incorporates a lever controlled cam which adjusts the height of the rear wheels of the nozzle assembly. The first mechanism requires two hands for operation and can be inadvertently changed by the application of pressure to the front of the nozzle assembly. The other mechanism has the disadvantage of being mounted at the rear of the nozzle assembly of the vacuum cleaner where the operator's view of the adjustment is obstructed by the flexible dust bag.

The rotating brush in an upright vacuum cleaner is generally caused to rotate by a drive belt or other flexible drive means connecting the blower motor to the brush. To avoid injury to the operator of the vacuum cleaner if the nozzle assembly is turned over or lifted up, and to prevent long pile carpeting from becoming entangled in the rotating parts, it is necessary to provide a cover for the rotating parts. However, as it will be necessary to repair or replace the drive belt, such cover must be readily removable; preferably without the use of tools. Because the bottom of the nozzle assembly is subjected to significant vibration, prior art latching means which were removable without the use of tools and lacking a positive operation did not prevent the latch from opening inadvertently due to such vibration. Furthermore, prior art latching means can be opened by children exposing the drive belt and creating a potentially dangerous condition.

SUMMARY OF THE INVENTION

Accordingly, it is broadly an object of the present invention to provide an upright vacuum cleaner which overcomes or avoids one or more of the foregoing disadvantages resulting from the use of prior art vacuum cleaner construction and construction techniques. Specifically, it is within the contemplation of the present invention to provide a new and improved upright vacuum cleaner construction which includes a rigid connection between the handle assembly including the dust bag and the output of the blower assembly in the nozzle assembly which allows relative rotation of the handle assembly to the nozzle assembly yet provides a durable seal between such assemblies.

It is a further object of this invention to provide an upright vacuum cleaner having a handle assembly fixedly mounted to the impeller housing which rotates as a unit about the nozzle assembly in a manner which allows the blower motor to be fixedly mounted to the nozzle assembly yet provides a durable seal between the nozzle assembly and the handle assembly.

It is a further object of the present invention to provide an upright vacuum cleaner having a construction wherein the impeller housing of the blower assembly is mounted within the nozzle assembly so as to rotate as a unit with the handle assembly yet the blower motor is substantially centrally located within the nozzle assembly.

It is a still further object of the present invention to provide an upright vacuum cleaner having a flexible dust bag which is retained by upper and lower bag retainers constructed to compensate for the change in length of the dust bag as it is inflated yet are simple and economical to manufacture and assemble, and are capable of being easily modified for compatibility with different vacuum cleaner models.

It is a still further object of the present invention to provide upper and lower bag retainers of a novel construction which can be assembled without the use of tools.

It is a still further object of the present invention to provide a height adjustment mechanism for an upright vacuum cleaner which can be readily adjusted by hand yet positively maintains the height adjustment of the nozzle assembly.

It is a still further object of the present invention to provide a nozzle assembly height adjustment mechanism which is capable of one-handed operation.

It is a still further object of the present invention to provide a nozzle assembly height adjustment mechanism which is constructed so that the user of the vacuum cleaner can visually discern the position of the height adjustment mechanism while the vacuum cleaner is in use.

It is a still further object of the present invention to provide a positive latching apparatus for securing a cover shielding the rotating parts beneath the nozzle assembly in a construction which cannot be inadvertently opened.

It is a still further object of the present invention to provide a latching apparatus for securing a cover shielding the rotating parts of the nozzle assembly housing which cannot be opened by a young child.

In accordance with an illustrative embodiment demonstrating objects and features of the present invention, there is provided an improved upright vacuum cleaner which has a nozzle assembly and a blower motor mounted to the nozzle assembly. The blower motor is mounted in such a manner that the housing of the blower motor does not rotate relative to the nozzle assembly. There is a handle assembly extending from the nozzle assembly. An impeller housing having integral inner and outer side walls is mounted to the blower motor so that the impeller housing may rotate relative to the blower motor. The handle assembly includes means for mounting such assembly to the impeller housing as a unit so that the combined impeller housing and handle assembly are rotatable relative to the nozzle assembly.

A further embodiment of the present invention provides a latching means for releasably securing a cover member to a housing member on the underside of the nozzle assembly so that the latching means cannot be inadvertently unlocked. The latching means includes a latch body mounted to the housing member and removable from a first position in superposed relation to a portion of the cover to a second position remote from the cover The latch body secures the cover member to the housing member when the latch body is in the first, locked position and allows for the removal of the cover member from the housing member when the latch body is in the second, unlocked position. There is a self-actuating retaining means in operative relation to the latch body which retains the latch body in the first position and prevents it from moving to the unlocked position. The latching means also includes an unlocking member projecting from the latch body which contacts the spring means when depressed to release the self-actuating retaining means.

In accordance with a still further embodiment demonstrating objects and features of the present invention, there is provided an adjustment means for controlling the distance of a vacuum cleaner nozzle assembly from the floor surface being cleaned, comprising a wheel assembly including an offset axle movably mounted to the vacuum cleaner nozzle assembly. There is an actuation member rotatably mounted to the front portion of the vacuum cleaner nozzle assembly which rotates about an axis substantially parallel to the floor surface. The actuation member has a camming surface with a plurality of cam lobes. There is a cam follower means located between the actuation member and the front axle so that movement of the actuation member causes the cam follower to move the front axle closer or further from the vacuum cleaner nozzle assembly causing the nozzle assembly to change its height relative to the floor surface.

In accordance with another embodiment of the present invention, there is provided a top retaining means for attaching the upper end of a flexible dust bag to a handle assembly of an upright vacuum cleaner. The top retaining means has a retaining channel or clip slidably mounted along the closed edge of the dust bag which maintains the upper end of the dust bag in its closed position. There is a cover means adapted to fit over the retaining clip and the upper terminus of the dust bag such that a substantial portion of the retaining clip is not exposed to view. A resilient mounting means is provided on the handle assembly adjacent the upper terminus of the dust bag, and there are means associated with one or more of the retaining clip or the cover means for attaching the resilient member to the handle assembly.

The present invention also provides a bottom retaining means for securing a closed edge portion of the lower terminus of the dust bag to the handle assembly of the upright vacuum cleaner. The bottom retaining means includes a first jaw member mounted to a lower portion of the handle assembly. There is a clasping means removably connected to the handle assembly including a second jaw member integral with the clasping means. When the clasping means is attached to the lower portion of the handle assembly, the closed edge portion of the lower terminus of the dust bag is retained between the first and second jaw members. The bottom retaining means may also provide a handle for manipulating the upright vacuum cleaner.

BRIEF DESCRIPTION OF THE DRAWINGS

For a fuller understanding of the objects, features, and advantages of the present invention, reference should be made to the following detailed description of the various preferred, but nonetheless, illustrative embodiments of the invention as illustrated by and taken in conjunction with the accompanying drawings wherein.

DETAILED DESCRIPTION OF THE PREFERRED EMBODIMENT

Figure 1:
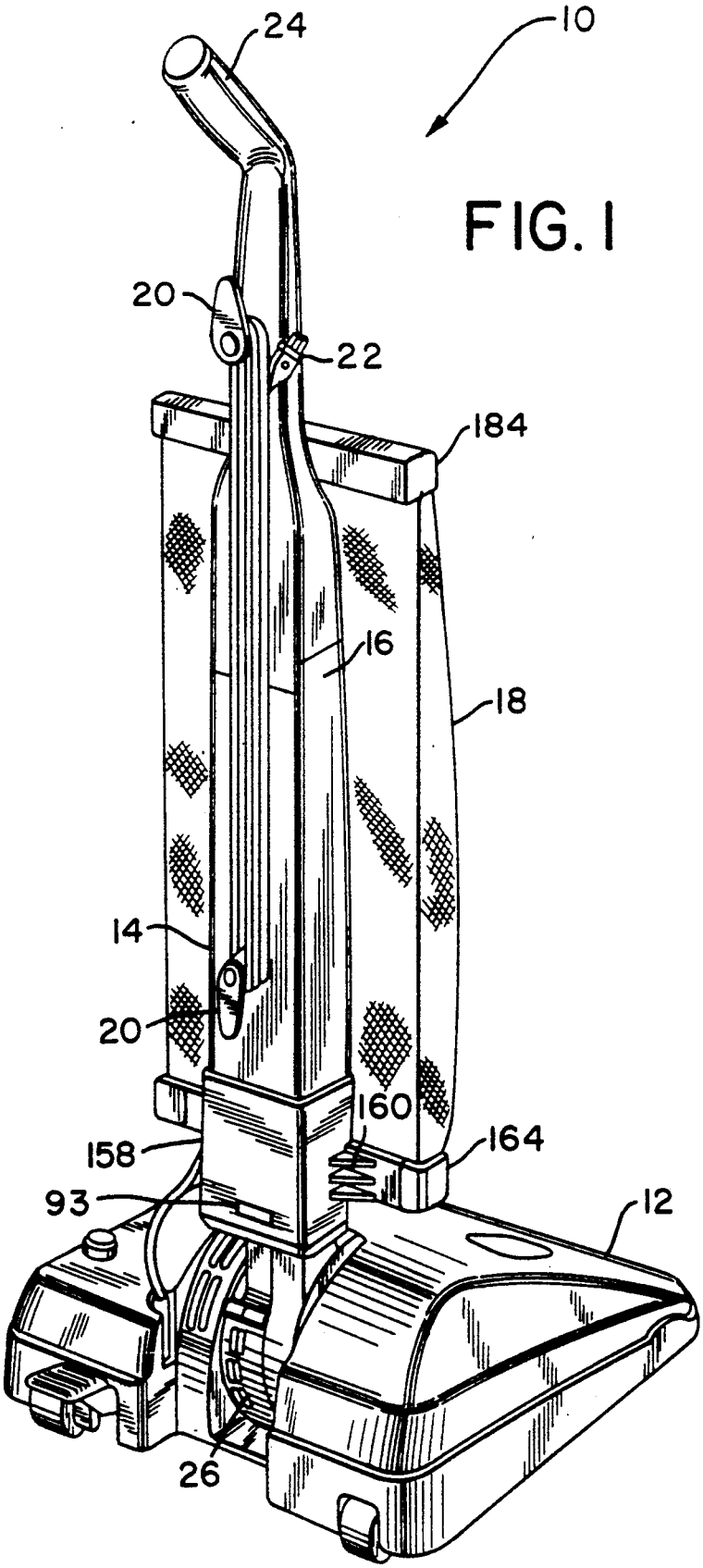
FIG. 1 is a perspective view of an upright vacuum cleaner incorporating various features of the present invention.

In the exemplary embodiment of the invention as disclosed in the drawings, there is shown in FIG. 1 a single motor upright vacuum cleaner generally designated by the reference numeral 10 constructed in accordance with the principles of the present invention, including a nozzle assembly 12 and a handle assembly 14. The handle assembly 14 is pivotally connected to the nozzle assembly 12, as more fully set forth below.

The handle assembly 14 includes a central conduit 16 which carries the pressurized air containing dust and particulate matter from the nozzle assembly 12 to a flexible dust bag 18. As more fully described below, the flexible dust bag 18 is mounted to the front surface of handle assembly 14. The vacuum cleaner 10 of the present invention utilizes a disposable bag (not shown) inside the flexible dust bag 18 to capture the dust and particulate matter. The disposable bag is removably connected to the central conduit 16 in the conventional manner.

The handle assembly 14 also includes cord posts 20, 20 for storing the power cord 22 which supplies electrical energy to the vacuum cleaner 10, and hand grip 24 for more comfortable manipulation of the vacuum cleaner 10 during operation.

In accordance with the present invention, the handle assembly 14 is rigidly connected to the impeller housing of a blower assembly 26 which pivots relative to the nozzle assembly 12. As will be discussed more specifically below, as shown in FIG. 5, portions of the blower assembly 26 are rotatably mounted to the nozzle assembly 12 by means of an inner mounting bearing 28 and an outer mounting bearing 30. The mounting bearings 28, 30 are fastened to the nozzle assembly 12 in such a manner that they allow rotation of the rotating portions of the blower assembly 26. The blower motor 32 is fixedly mounted to the nozzle assembly 12 by a motor mount 34 and a rubber bushing 36 (see FIG. 4) and does not rotate with the rotating components in the blower assembly 26.

Figure 2:
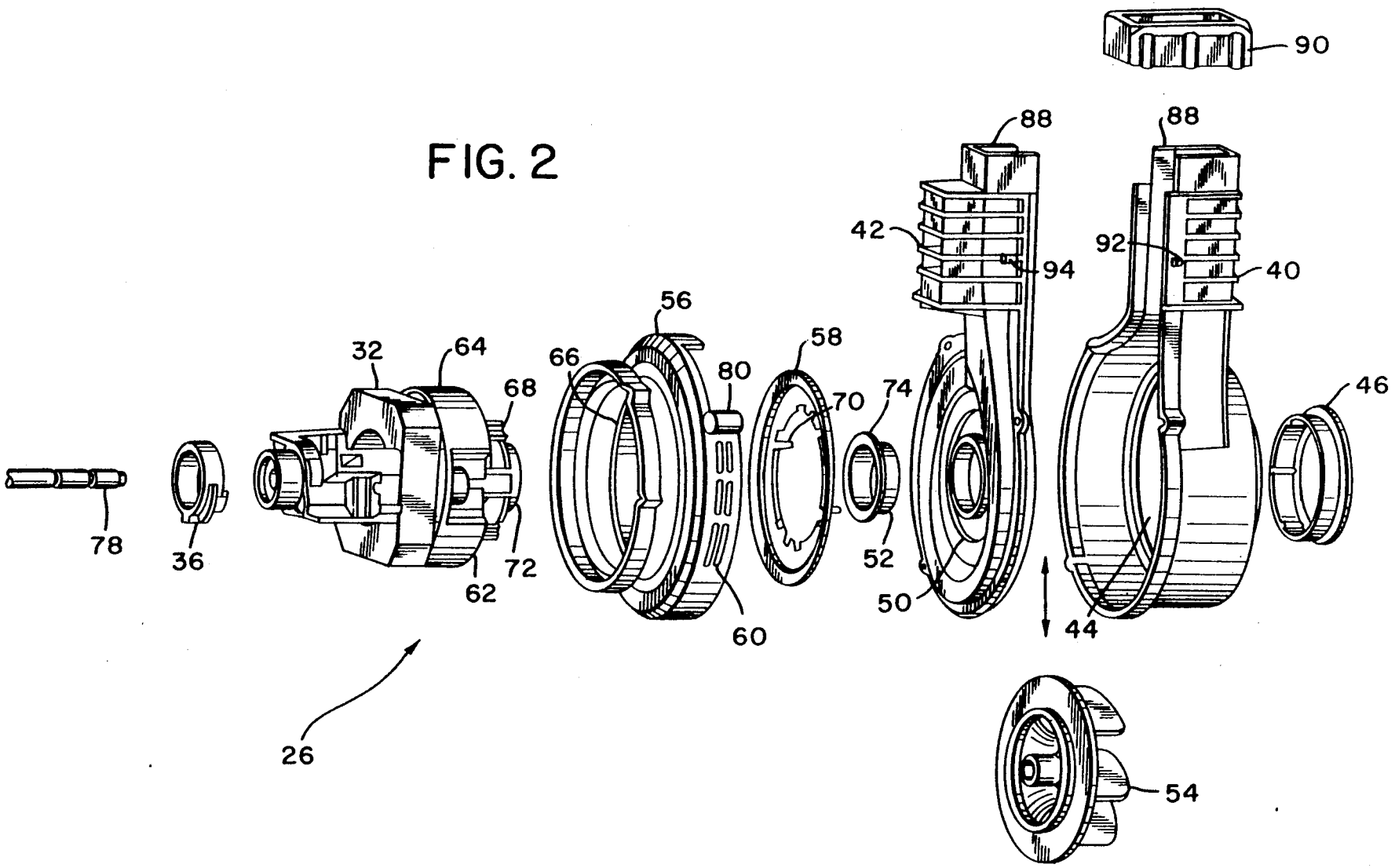
FIG. 2 is an exploded perspective view of the blower motor and impeller housing assembly.

As best shown in FIG. 2, the blower assembly 26 includes an impeller housing assembly 38 constructed from an outer impeller housing 40 and an inner impeller housing 42, preferably molded from plastic. The outer impeller housing 40 includes an integral side wall 44. There is a vacuum inlet opening in the side wall 44 and an outer blower seal 46 which is fitted within the vacuum inlet opening. The outer blower seal 46 seals against the vacuum plenum 48, best shown in FIG. 5.

The inner impeller housing 42 includes an integral side wall 50 with an orifice to receive the inner blower seal 52. Preferably the inner blower seal 52 is made from Delrin or a similar material. The side walls 44, 50 cooperate to form the impeller housing assembly 38 which has a substantially continuous cavity that houses the impeller 54. Once the blower assembly 26 is fully assembled, the impeller housing assembly is substantially airtight.

The blower assembly 26 also includes the blower motor 32, a motor cover 56, and a motor retaining plate 58. The motor cover 56 can also be molded out of plastic. As explained more fully below, the blower motor 32 can be of the open winding type so that it can be mounted more compactly within the nozzle assembly 12. The open winding construction also allows the blower motor 32 to be effectively cooled by secondary air flow through the cooling slots 60 in the motor cover 56.

In accordance with the present invention, the assembly of the blower assembly 26 is simple and requires little hardware. The blower assembly 26 is assembled by first inserting the blower motor 32 fully into the motor cover 56 until the front face 62 of the motor housing 64 engages the inner surface 66 of the motor cover 56. The blower motor 32 is retained within the motor cover 56 by a motor retaining plate 58 affixed to the inner front face 68 of the blower motor 32 by bending tabs 70 on the motor retaining plate 58 such that the tabs 70 lock into corresponding slots (not shown) on blower motor 32.

Next, the inner blower seal 52 slides over the bushing 72 on blower motor 32 such that the collar 74 on the inner blower seal 52 seals against the inner front face 68 of the blower motor 32 forming a substantially airtight seal. When the blower motor 32 is inserted into the motor cover 56 and the motor retaining plate 58 is locked in place, the motor retaining plate 58 not only prevents axial movement of the blower motor 32, but it also serves as an inner baffle to define a clean-air cooling passage 76 for the blower motor 32. The cooling passage 76 is also defined by the integral side wall 50 of the inner impeller housing 42. A small cooling fan (not shown) is mounted to the shaft 78 of the blower motor 32 in the area of the cooling passage 76 so that clean air enters and exits the cooling slots 60 on the motor cover 56, thereby cooling the open windings of the blower motor 32.

After the inner impeller housing 42 is slid over the inner blower seal 52, the impeller 54 is fastened to the blower motor shaft 78. Next, the outer impeller housing 40 is assembled to the inner impeller housing 42 to form the impeller housing assembly 38. The blower assembly 26 is secured together by three self-tapping retaining screws (not shown) which pilot through both the outer impeller housing 40 and the inner impeller housing 42 and are screwed into threaded bosses 80 —80 on the periphery of the motor cover 56.

Figure 3:
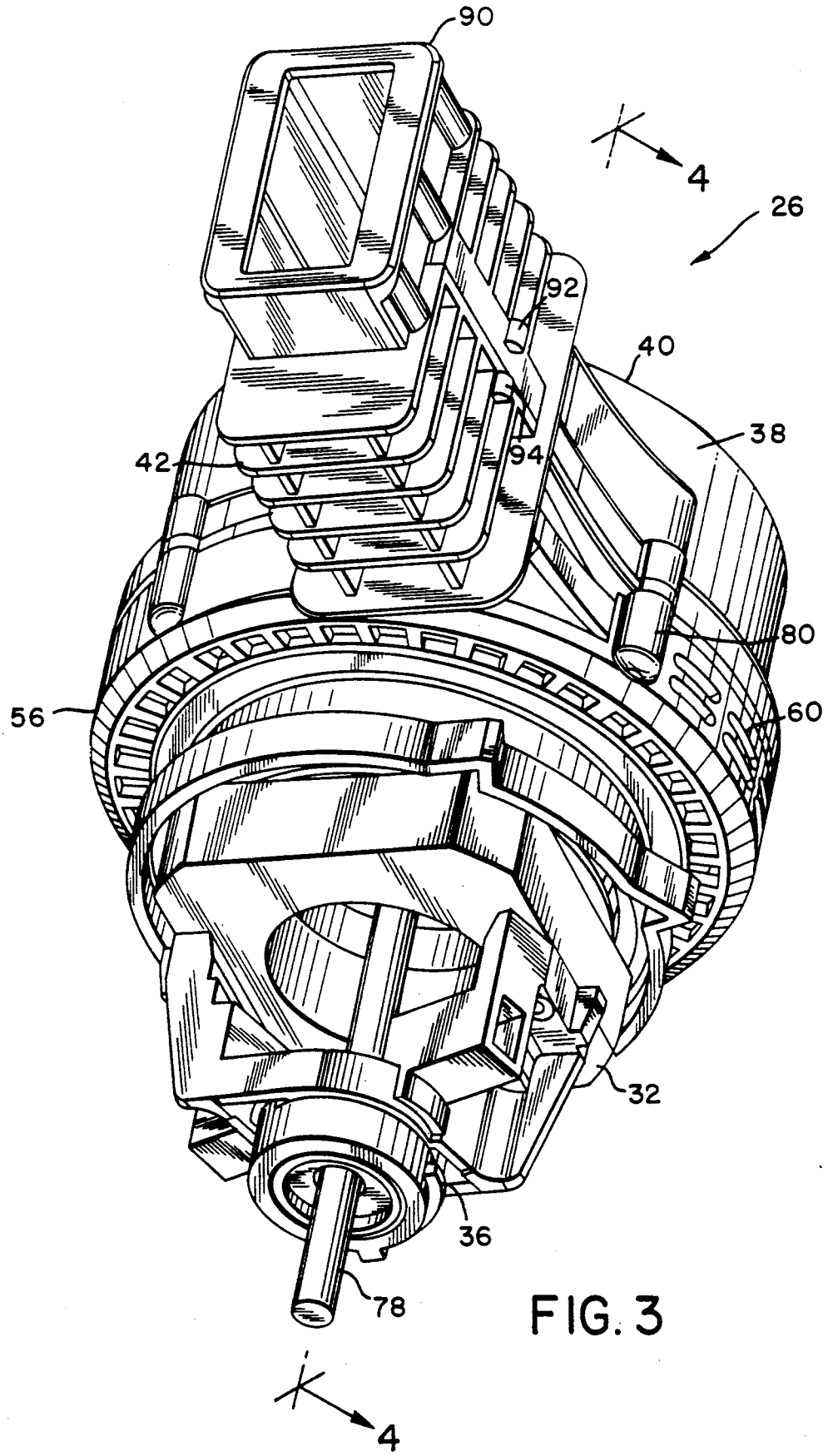
FIG. 3 is a perspective view of the blower assembly.

When assembled as shown in FIG. 3, the blower assembly includes a cooling passage 76 formed between the motor cover 56 and the inner impeller housing 42 which serves to provide the flow of clean air for cooling the blower motor 32.

Figure 4:
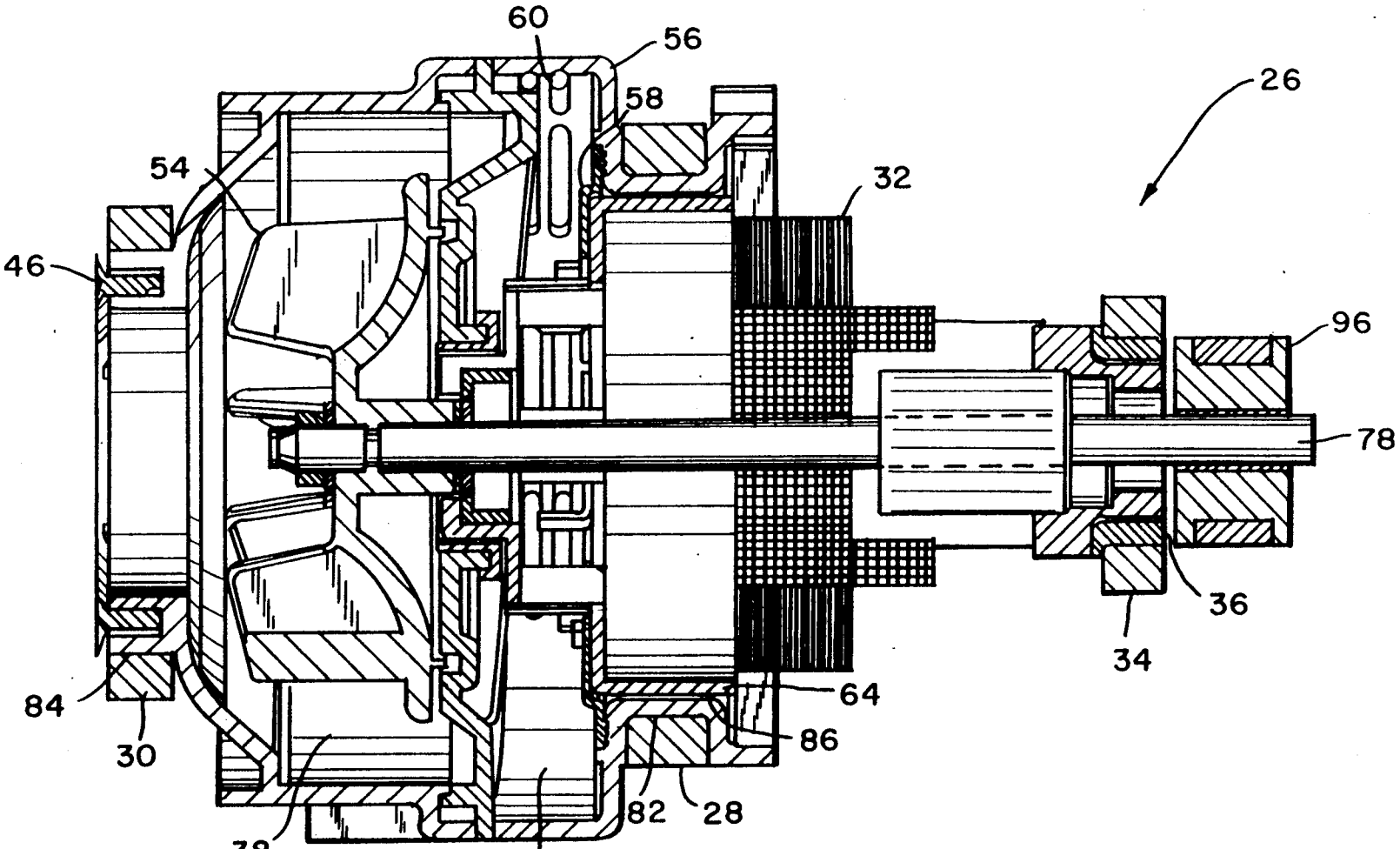
FIG. 4 is a cross-section of the blower motor and impeller housing assembly taken along the line 4—4 in FIG. 3.
Figure 4A:
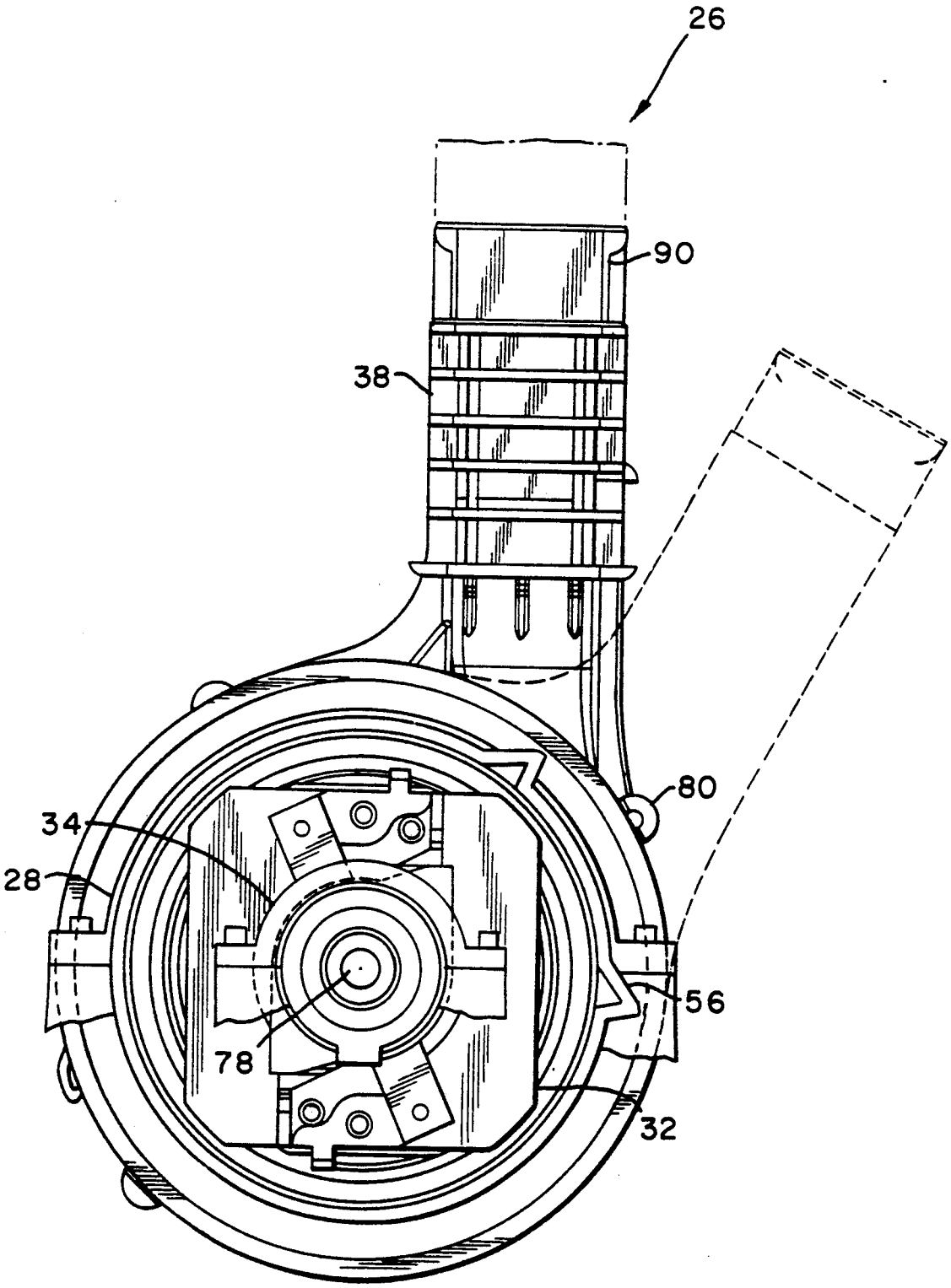
FIG. 4A is a side elevational view of the blower motor and impeller housing assembly illustrating the assembly in its rotated position in phantom.
Figure 5:
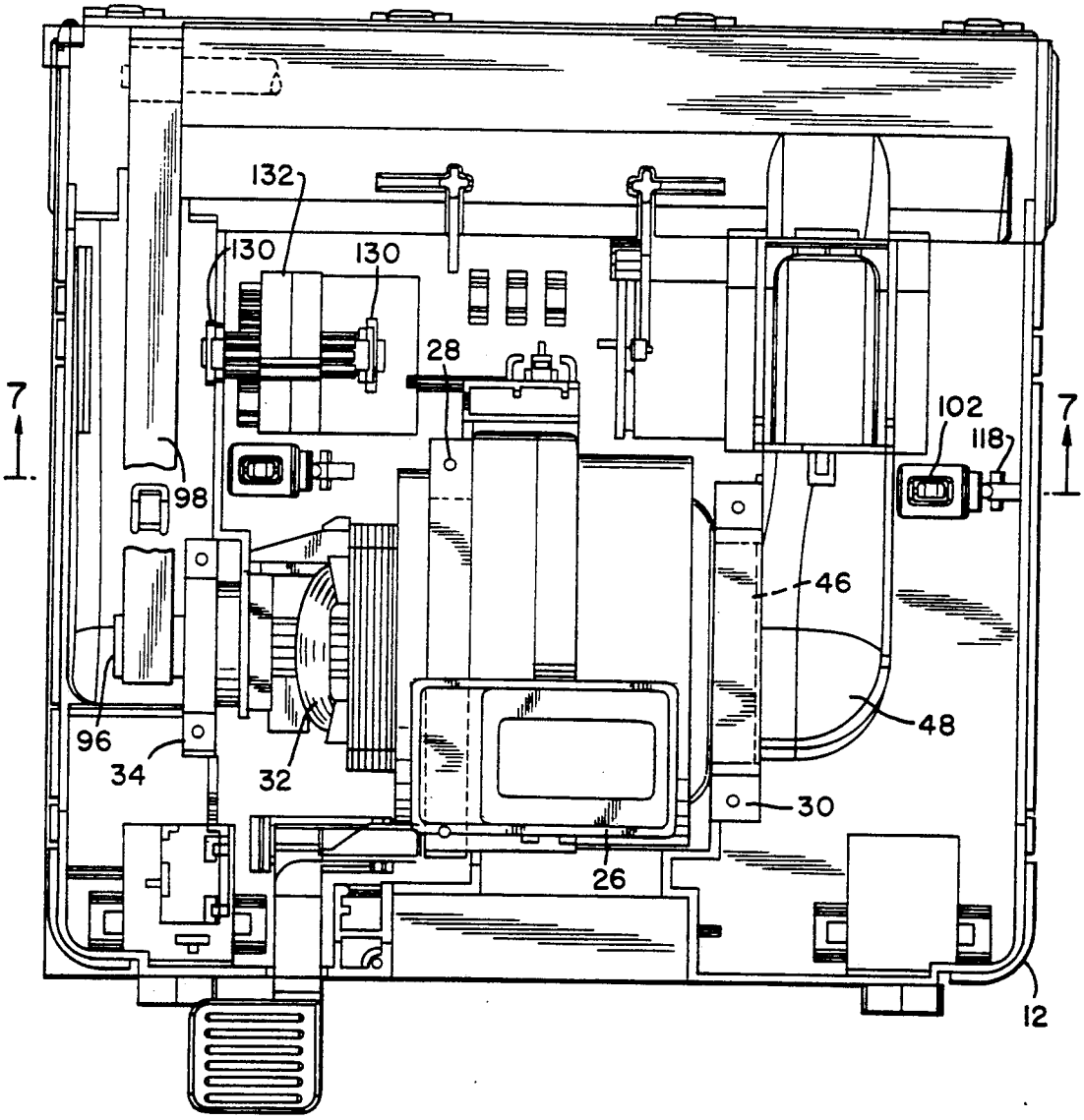
FIG. 5 is a top plan view of the nozzle assembly with the ornamental housing cover removed illustrating the location of the blower motor and impeller housing assembly and the latching apparatus of the present invention.

As best shown in FIGS. 4 and 4A, the impeller housing assembly 38 of the vacuum cleaner 10 of the present invention rotates relative to the blower motor 32. The relative rotation is accomplished by mounting the impeller housing assembly 38 and the motor cover 56 of the blower assembly 26 to the nozzle assembly 12 by means of an inner mounting bearing 28 and an outer mounting bearing 30. The inner mounting bearing 26 is fastened around an inner mounting bearing surface 82 formed in the motor cover 56 of the blower assembly 26. Similarly, the outer mounting bearing 30 encompasses the outer mounting bearing surface 84 formed in the outer impeller housing 40 of the impeller housing assembly 38. The inner mounting bearing 28 and outer mounting bearing 30 cooperate to define as axis of rotation for the rotating portion of the blower assembly 26 which corresponds to the axis of rotation of the drive shaft 78 of the blower motor 32. The motor cover 56 contains a recessed portion 86 which provides clearance for the blower motor housing 64 as the impeller housing assembly 38 rotates between the two positions shown in FIG. 4A.

The blower motor 32 is prevented from rotating with the blower assembly 26 by a motor mount 34 which fixedly mounts the blower motor 32 to the nozzle assembly 12. The motor mount 34 incorporates a rubber bushing 36 between the frame of the blower motor 32 and the motor mount 34 to reduce the vibration transmitted to the nozzle assembly 12 from the blower motor 32. The blower motor 32 remains fixedly mounted to the nozzle by the combination of the motor mount 34 at one end which prevents all movement of the blower motor 32, including rotation, and the inner blower seal 52 at the other end, which serves as a bearing to prevent all movement except rotation by virtue of inner and outer mounting bearings 28, 30, respectively.

The impeller housing assembly 38 and the motor cover 56 rotate relative to the blower motor 32 and the remainder of the nozzle assembly 12, from the upright orientation shown by the solid lines in FIG. 4A to the rotated position shown by the phantom lines. During rotation, the impeller housing assembly 38 formed by the outer and inner impeller housings 40, 42, respectively, and the motor cover 56 fastened thereto rotate about the inner and outer mounting bearings 28, 30 and about the motor retaining plate 58 which remains fixed relative to the nozzle assembly 12 and the blower motor 32 mounted thereto.

During rotation, the inner blower seal 52 seals the impeller housing assembly 38 formed by the outer impeller housing 40 and inner impeller housing 42. Because the inner mounting bearing 28 and the outer mounting bearing 30 are external to the blower assembly 26, a flexible sealing element need not be incorporated in these bearings. This construction allows rotation of the impeller housing assembly 38 relative to the nozzle assembly 12, utilizing relative large bearing surfaces which carry the load, thereby avoiding placing undue stress on the seals as in the prior art. This construction also eliminates the need for a vacuum sealing surface in these highly stressed areas. Further, the provision of integral side walls 44, 50 in the outer impeller housing 40 and the inner impelled housing 42, respectively, improves the sealing of the impeller housing assembly 38 relative to the non-rotating components of the blower assembly 26.

This construction also enables the blower motor 32 to be mounted near the center line of the nozzle assembly 12. Thus, when the vacuum cleaner 10 of the present invention is operated, there is no tendency for the vacuum cleaner 10 to rotate about the centrally located handle assembly 14 and cause undue fatigue to the operator of the vacuum cleaner.

The handle assembly 14 containing the central conduit 16 is rotatably attached to the nozzle assembly 12 by engaging the handle assembly 14 over the impeller housing outlet 88 at the upper portion of the impeller housing assembly 38. In operation, dust- an dirt-carrying air is caused to exit from the impeller housing outlet 88 under pressure. This pressurized air is directed through the central conduit 16 of the handle assembly 14 into the disposable bag inside the flexible dust bag 18. To avoid the escape of this pressurized air, an impeller housing outlet seal 90 is mounted around the impeller housing outlet 88 of the impeller housing assembly 38. When the handle assembly 14 is mounted to the impeller housing assembly 38 in telescoping relationship and retained in place by tables 92, 94 on outer impeller housing 40 and inner impeller housing 42, respectively, which lock into a slot 93 on handle assembly 14, an airtight seal is created.

Figure 6:
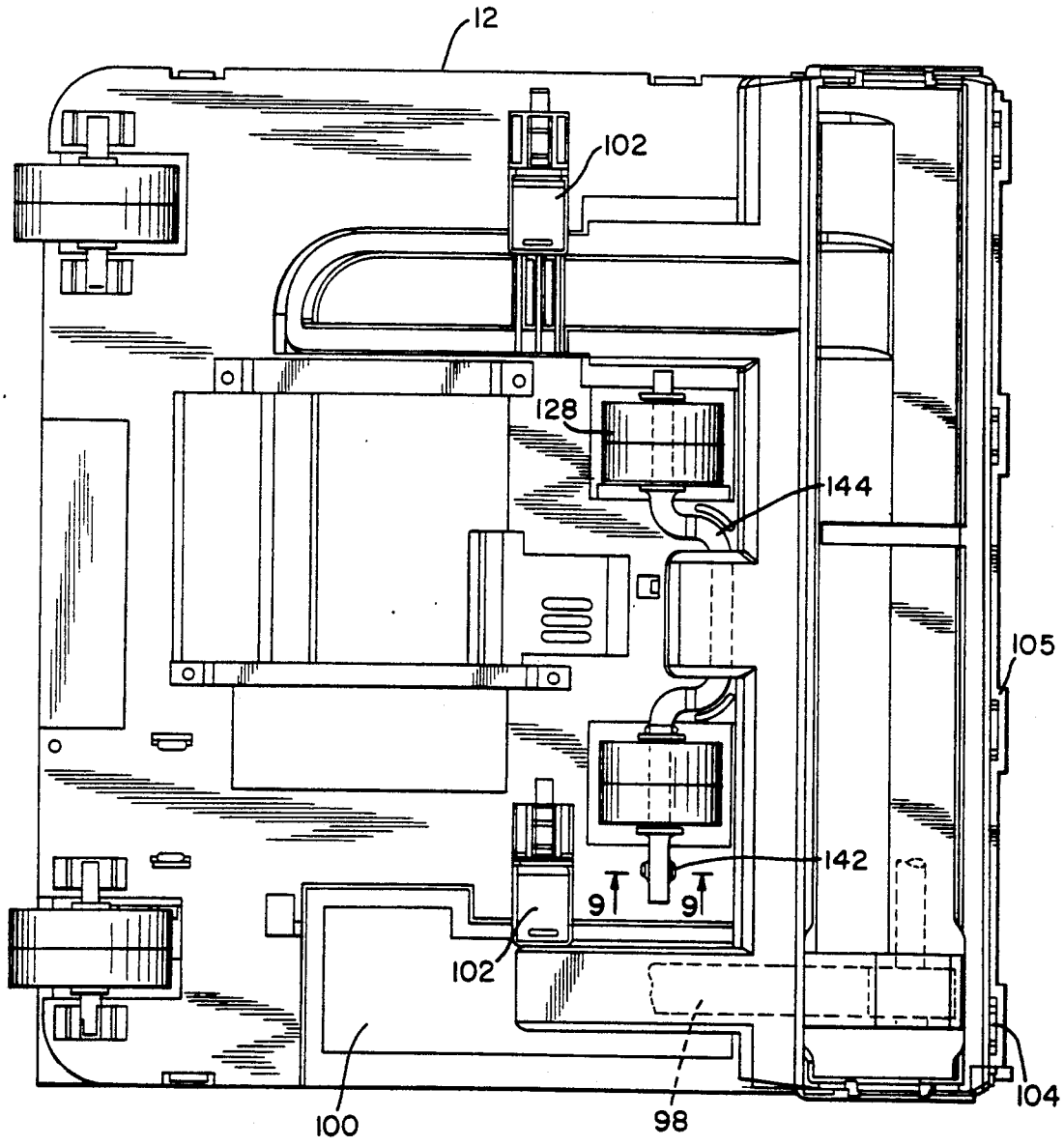
FIG. 6 is a bottom plan view of an upright vacuum cleaner employing a latching apparatus and a height adjustment apparatus according to the preferred embodiment of the invention.

As shown in FIG. 5, a pulley 96 is attached to the portion of the motor shaft 78 at the commutator end of the blower motor 32 adjacent the fixed motor mount 34. Pulley 96 transits the rotation of the blower motor 32 through belt 98 to an agitator brush (not shown) at the front of the nozzle assembly 12. To facilitate changing the belt 98, a cover 100 is provided on the bottom surface of the nozzle assembly 12 (FIG. 6). When removed, the cover 100 exposes both belt 98 and a vacuum plenum 48 which serves to direct airflow from the agitator brush (not shown) to the inlet of the blower assembly 26 past the outer blower seal 46. Because the cover 100, when removed, exposed rotating parts, the present invention further includes a positive latching assembly 102 which secures the cover 100 to the bottom of the nozzle assembly 12.

The cover 100 is substantially U-shaped covering the exposed portion of the drive belt 98 on the bottom on the nozzle assembly 12 and forms the bottom wall of the vacuum plenum 48. The cover also surrounds the agitator brush (not shown) retaining the agitator brush in place and sealing the vacuum passage around the agitator brush in the conventional manner. The cover 100 is removably fastened to the bottom of the nozzle assembly 12 by a plurality of hooks 104 extending from the front surface of the cover 100 which engage corresponding retainers 105 located on the bottom of the nozzle assembly 12 in an otherwise conventional manner. The cover 100 is attached to the bottom of the nozzle assembly 12 by hooking the hooks 104 into the retainers 105 and rotating the cover 100 around the hooks 104 until the cover 100 seats within a recess 114 on the bottom of the nozzle assembly 12. The cover is retained within the recess 114 by a pair of positive latching assemblies 102, 102.

Figure 7:
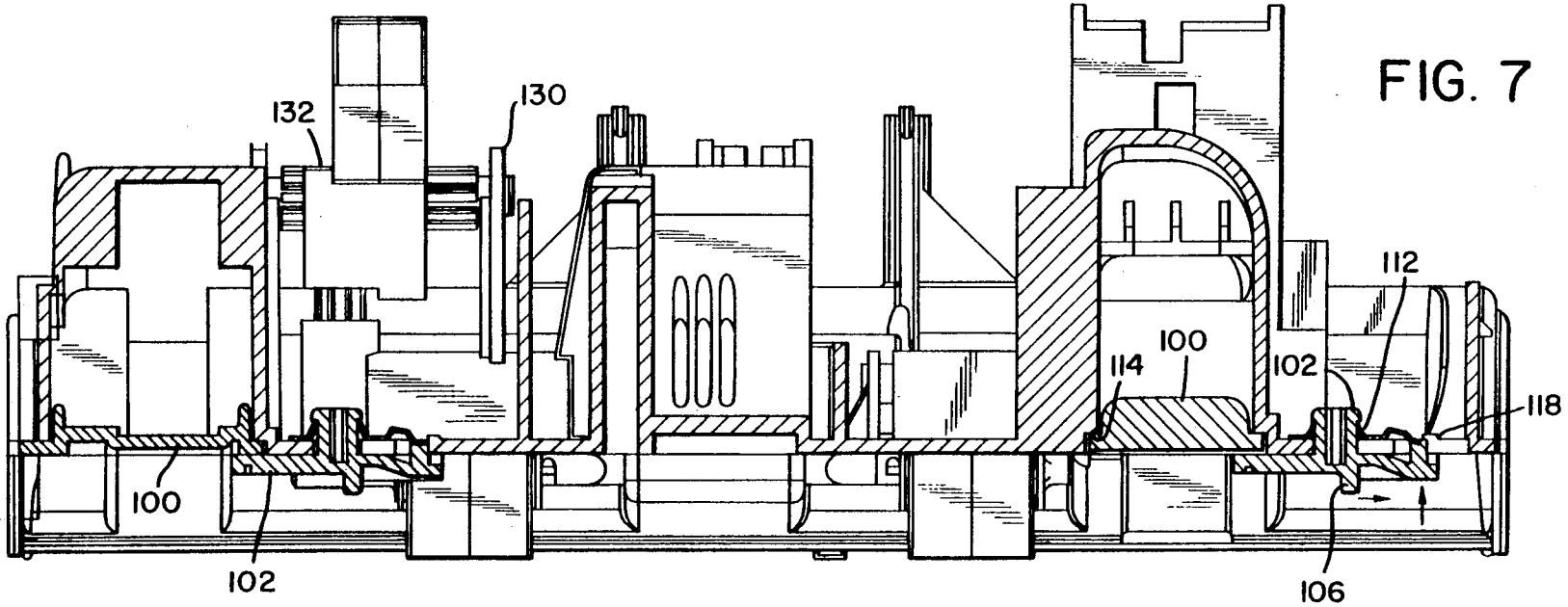
FIG. 7 is a vertical cross-section of the nozzle assembly taken along the line 7—7 in FIG. 5, looking in the direction of the arrows.
Figure 8:
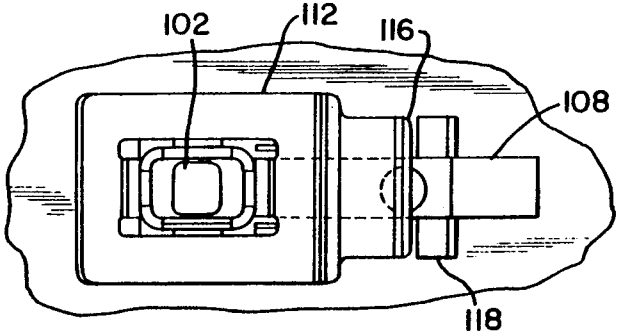
FIG. 8 is a fragmentary top plan view of the latching apparatus in the closed position.
Figure 7A:
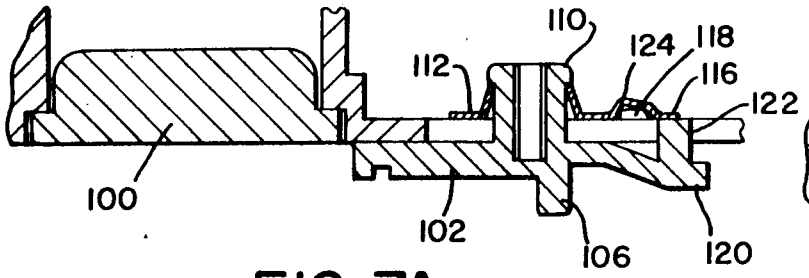
FIG. 7A is an enlarged fragmentary cross-section of the latching apparatus of the present invention in the open position.

As best shown in FIG. 7, 7A and 8, the latching assembly 102 includes a latch body 106 mounted to the nozzle assembly 12 through an elongated slot 108. The latch body 106 has a T-shaped body. The projecting portion 110 of the T-shaped body extends through the nozzle assembly 12 and is retained to the nozzle assembly by means of a spring clip 112 which snaps over the projecting portion 110 and is retained in place by a widened area at the top of the projecting portion 110 of the latch body 106. The closed position of the latch assembly 102 is illustrated in FIG. 7 wherein the leading edge of the latch body 106 in its closed orientation is in superposed relationship to a portion of the cover 100. In such orientation, the leading edge of the latch body 106 prevents the cover 100 from rotating out of engagement in the recess 114 of the nozzle assembly 12.

The spring clip 112 serves a function in addition to merely retaining the latch body 106 within the nozzle assembly 12. In particular, the spring clip 112 has a locking edge 116 which is snap fastened to the latch body 106 so that the locking edge 116 is on the side of the latch body 106 remote from its leading edge. The locking edge 116, when the latch body 106 is in its locked orientation, abuts a pair of locking tabs 118, 118 mounted on the top of the nozzle assembly 12. Thus, once the latch body 106 is moved to the locking position shown in FIG. 7, in order to unlock the latching assembly 102, it is necessary to release the locking edge 116 of the spring clip 112 from its engagement with locking tabs 118, 118. The unlocking is achieved by depressing the release member 120 which causes an integrally formed releasing post 122 to contact the locking edge 116 of the spring clip 112 and urge the locking edge 116 out of engagement with the locking tabs 118, 118 by raising the locking edge 116 over the locking tabs 118, 118.

In order to move the latching assembly 102 to its released position as shown in FIG. 7A, the operator must depress the release member 120 causing the integral post 122 to contact the locking edge 116 of the spring clip 112 causing it to clear the locking tabs 118, 118. Simultaneously, the operator slides latch body 106 in a direction away from the cover 100 until the leading edge of the latch body 106 comes out of engagement with the cover 100. When both latch assemblies 102, 102 are opened, the cover 100 can then be removed from the nozzle assembly 12 by pivoting the cover 100 away from the nozzle assembly 12 around the front hooks and retainers 104, 105.

To lock the latching assembly 102, the operator slides the latch body 106 to the locked position shown in FIG.

7 wherein the leading edge of the latch body 106 is in superposed relationship to the cover 100. The spring clip 112 is constructed with a sloped portion formed in a recessed section 124 which cooperates with sloped surfaces on the locking tabs 118, 118 to allow the spring clip 112 to move over the locking tabs 118, 118 when the latch body 106 is slid by the operator from the unlocked to the locked position. The cooperating surfaces avoid the need for the operator to depress the release member 120 to lock the latching assembly 102.

Figure 10:
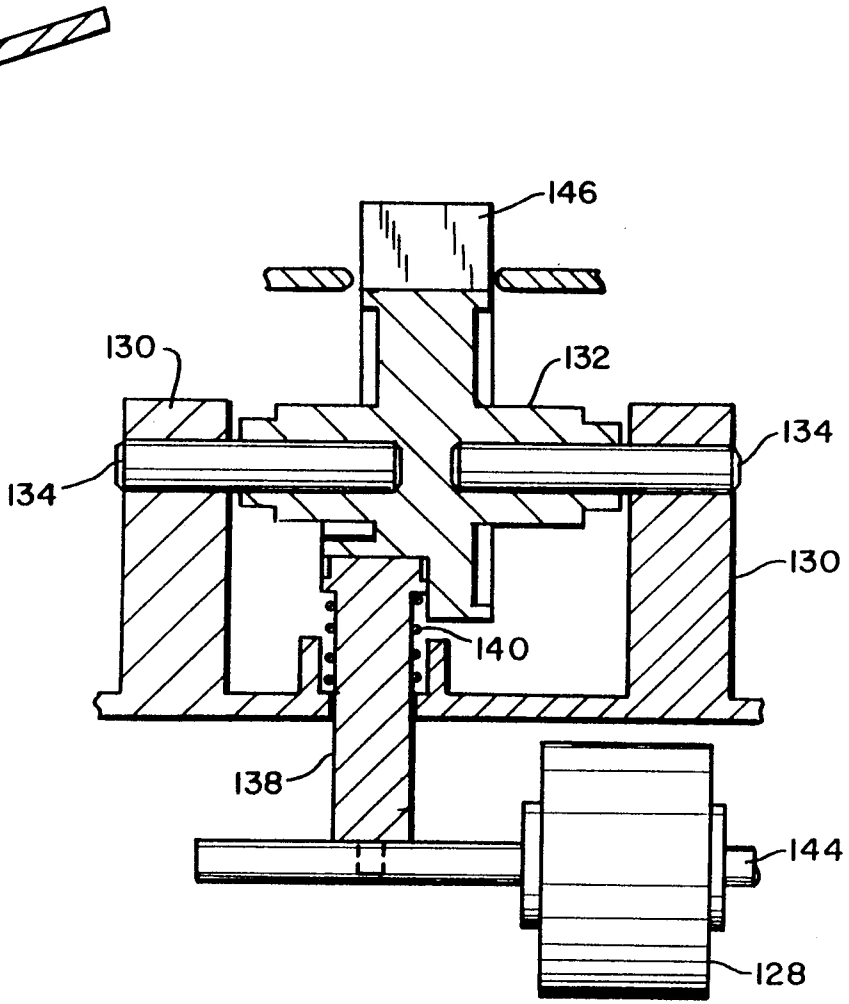
FIG. 10 is a fragmentary vertical section view taken along line 10—10 in FIG. 9, looking in the direction of the arrows, illustrating the height adjustment apparatus.
Figure 9:
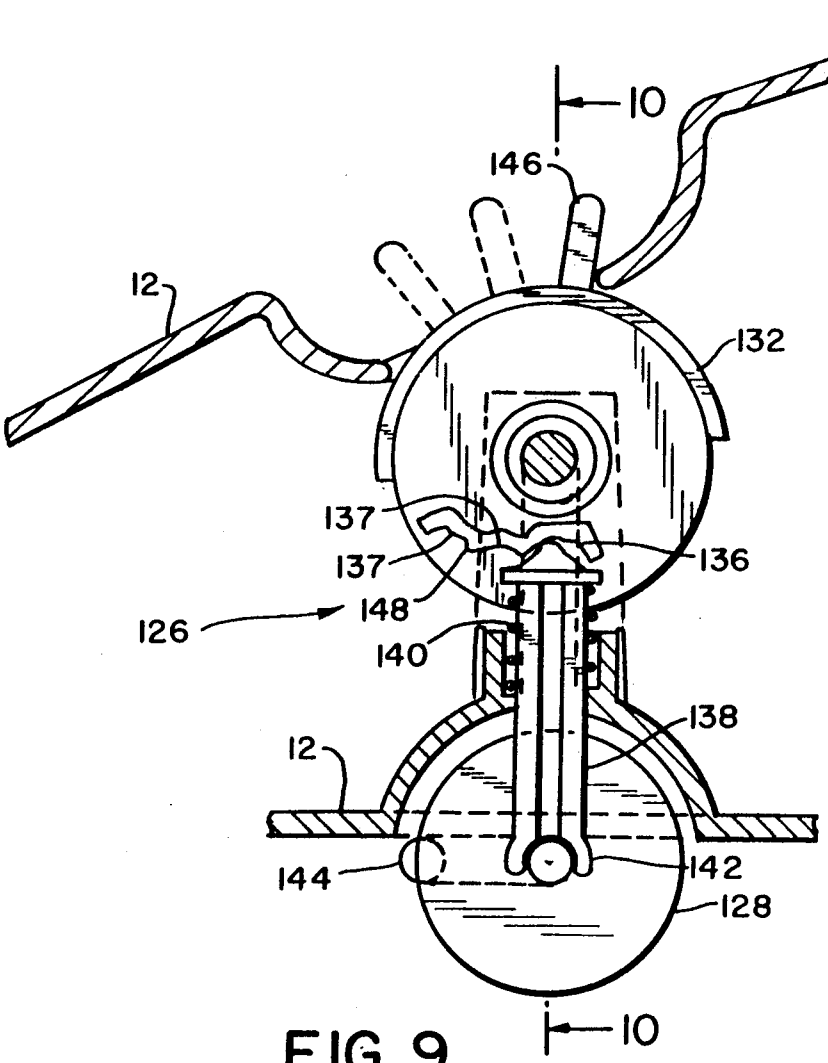
FIG. 9 is a fragmentary vertical section view showing the height adjustment apparatus of the present invention.
Figure 11:
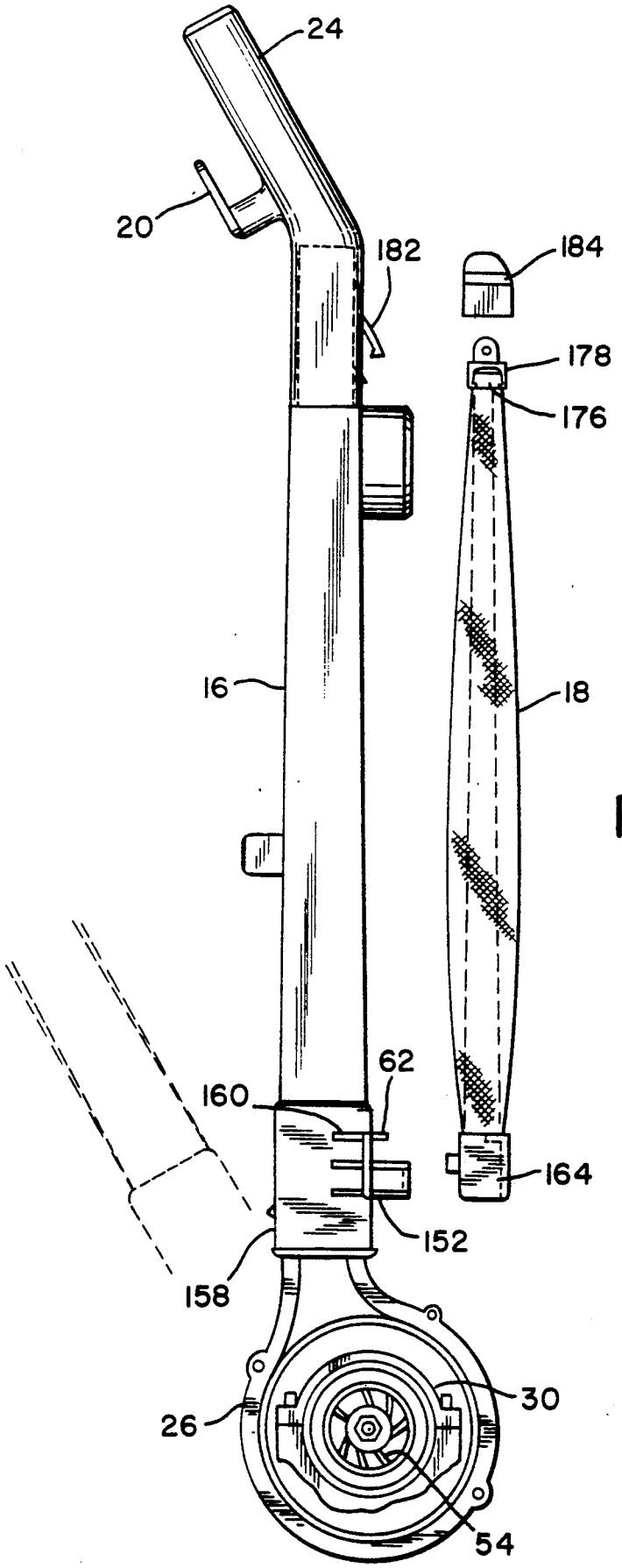
FIG. 11 is a exploded side elevation of the handle assembly illustrating the upper and lower dust bag retainers of the present invention and the connection of the handle assembly to the blower assembly.

The vacuum cleaner 10 of the present invention incorporates an improved height adjustment assembly located in the front portion of nozzle assembly 12. As described more fully below, the height adjustment assembly 126 changes the height of the agitator brush (not shown) above the surface of the floor being cleaned by extending or retracting the front wheels 128, 128 relative to the nozzle assembly 12. The details of construction of the improved height adjusting assembly 126 are best shown in FIGS. 9 and 10.

The height adjustment assembly 126 is mounted to a pair of upright struts 130, 130 molded to the top surface of the nozzle assembly 12 (see FIG. 5). The height adjustment assembly 126 includes a rotary actuation number 132 rotatably mounted to the upright struts 130, 130 about pivot pin 134, 134 which may be integrally molded with the rotating actuation member 132. As best shown in FIGS. 9 and 10, the rotary actuating member 132 is essentially cylindrical. A portion of the cylindrical surface has been removed and shaped as shown in FIG. 9 to provide the camming surface 136. The non-releaved portion of the actuation member 132 provides a stop 137.

A push rod 138 is slidingly mounted through the nozzle assembly 12 adjacent the camming surface 136 of the actuation member 132. The stop 137 helps maintain the push rod 138 in engagement with the camming surface 136. A compression spring 140 is mounted around the push rod 138 between the nozzle assembly 12 and the camming surface 136 to bias the push rod 138 against the camming surface 136. The push rod 138 is mounted directly beneath the rotary actuation member 132 such that the axis of the push rod 138 intersects the axis of rotation of the rotary actuation member 132. Additionally, the camming surface 136 of the rotary actuation member 132 has a plurality of camming flats molded therein at varying distances from the axis of rotation of the rotary actuation member 132. Thus, as the actuation member 132 is rotated, different camming edges are caused to engage the push rod 138. As each camming has a different radial displacement, the push rod 138 will be displaced a different axial distance based thereon.

The lower end of the push rod 138 has a fork 142. The front wheels 128, 128 are mounted to a hat shaped offset axle 144. A portion of the offset axle 144 between the two front wheels 128, 128 is rotatable mounted to the bottom of the nozzle assembly 12 as generally shown in FIG. 9 and, as the free ends of the offset axle 144 rotate about the center portion, the distance between the axis of the free ends of the offset axle 144 and the bottom of the nozzle assembly 12 may vary. The front wheels 128, 128 are each mounted on the respective free ends of the offset axle 144. The fork 142 engages one free end of the offset axle 144 so that as the push rod 138 is caused to move axially, the axial movement of the push rod 138 is translated to rotational movement of the free ends of the offset axle 144 relative to its fixed section thereby causing the front wheels 128, 128 mounted to the offset axle 144 to move up and down relative to the bottom surface of the nozzle assembly 12.

The height of the nozzle assembly 12 is adjusted by the operator rotating the actuation member 132 by displacing a height adjustment lever 146 mounted on the periphery of the actuation member 132. For example, as the actuation member 132 is rotated counterclockwise as shown in FIG. 9 and the height adjustment lever 146 moved from the position shown by the solid line to the positions shown by the phantom lines, camming surface 136 rotates presenting different camming surfaces of increasing radial distances from the axis of pivot pins 134, 134 causing push rod 138 to move downwardly a distance corresponding to the increase in the radial distance of each camming surface. Movement of push rod 138 downwardly in turn causes fork 142 to rotate the offset axle 144 downwardly so that the distance of the front wheels 128, 128 from the bottom surface of the nozzle assembly 12 is increased causing the nozzle assembly 12 to be raised off the surface of the floor.

Each lobe 137 of the camming surface 136 on the rotary actuation member 132 is shaped so that when the lobe 137 is in engagement with the push rod 138, the surface of the lobe 137 is substantially perpendicular to the central axis of the push rod 138. Further, the camming surface 136 is constructed so that there is a lowered shoulder 148, 148 defining the extremities of each cam lobe 137. The perpendicular cam surface in combination with the lowered shoulders 148, 148 assures that the height adjustment will not inadvertently change. The use of a camming surface perpendicular to the central axis of the push rod 138 prevents the generation of any rotational moments which would cause unintended rotation of the actuation member 132 and correspondingly unattended adjustment of the height adjustment assembly 126. Further, the use of lowered shoulders 148, 148 to define the cam lobes 137 requires that the push rod 138 move downwardly a short distance before the rotary actuation member 132 can be moved either clockwise or counterclockwise thereby further avoiding the inadvertent and unintended adjustment of the height adjustment assembly 126.

The adjustment of the height adjustment assembly is particularly resistant to unintended changes due to increased load on the offset axle 144 as the lowered shoulders 148 prevent the rotary member 132 from inadvertently rotating unless the push rod 138 is able to move downwardly a short distance to clear the shoulders 148 between adjacent lobes 137. Such movement is not easily possible unless the load on the offset axle 144 is momentarily decreased.

Location of the height adjustment assembly 126 at the front corner of the nozzle assembly 12 assures that the operator will be able to visually discern the height adjustment while operating the vacuum cleaner 10.

Preferably, the rotary actuation member is molded from plastic or a similar material. Additionally, the pivot pins 134, 134 can be integrally molded as part of the rotary actuation member 132. The rotary actuation member 132 can be mounted within the upright struts 130 by snapping the pins 134 into corresponding recess in the struts 130.

Figure 12:
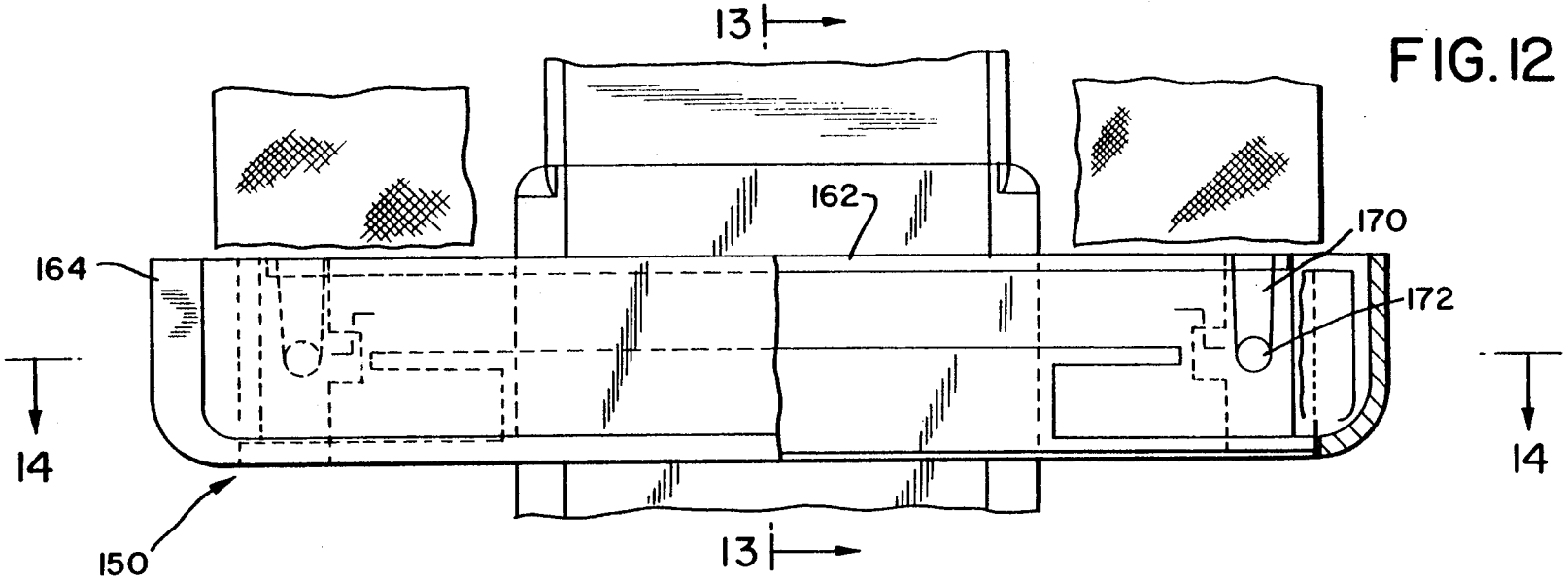
FIG. 12 is a fragmentary front elevational view in partial section of the lower bag retainer.
Figure 14:
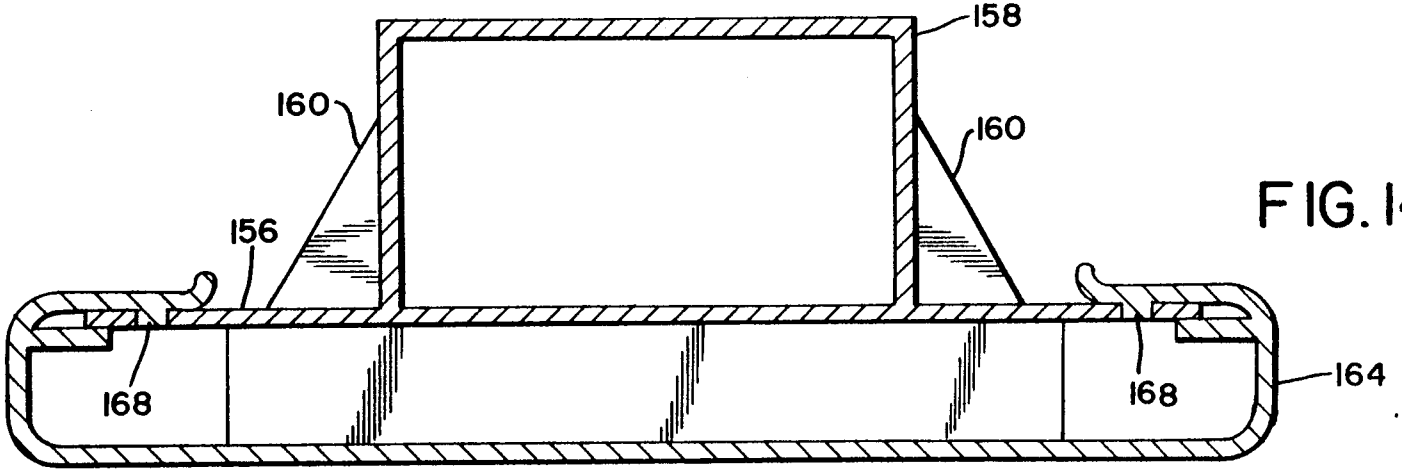
FIG. 14 is a horizontal cross-section of the lower bag retainer and handle assembly taken along line 14—14 in FIG. 12, looking in the direction of the arrows.
Figure 13:
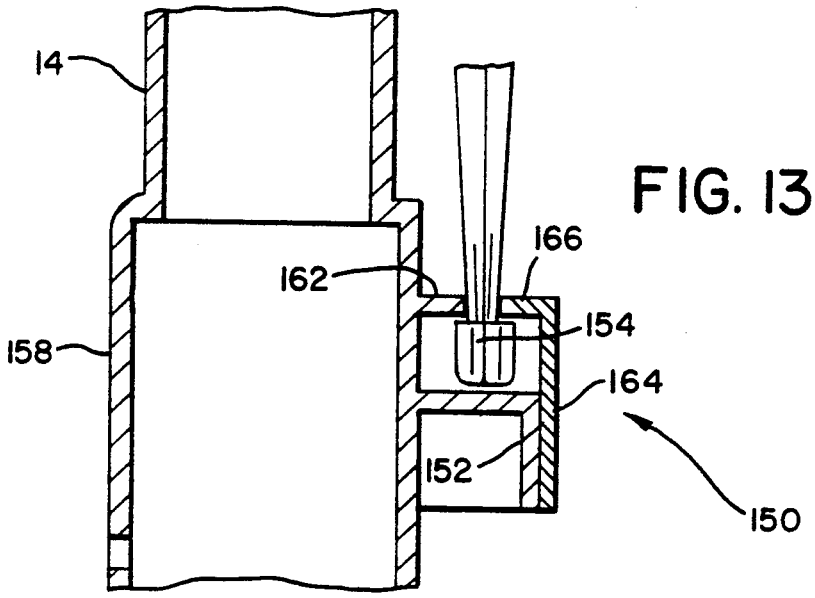
FIG. 13 is a vertical cross-section taken along the line 13—13 in FIG. 12, looking in the direction of the arrows, illustrating the lower bag retainer.

The vacuum cleaner 10 of the present invention still further includes a means for retaining the flexible dust bag 18 to the handle assembly 14. As best shown in FIGS. 12, 13 and 14, the bottom of the flexible dust bag 18 is mounted to the handle assembly 14 by a bottom retaining assembly 150. The bottom retaining assembly 150 also includes a handle 152 for manipulating the vacuum cleaner 10 over irregular surfaces such as stairs. The details of construction of the bottom bag retaining assembly 150 are described as follows.

The bottom retaining assembly 150 is constructed and arranged to engage the lower terminus 154 of the flexible dust bag 18. The flexible dust bag 18 is a tubular bag flattened at the top and the bottom. The sides of the bag are folded inwardly so that at the outer edges of each terminus are four thicknesses of material compressed together. Additionally, a plastic reinforcement member (not shown) is utilized to add thickness and strength to each bag terminus. Both the upper and lower termini are constructed in the same manner. The bottom retaining assembly 150 is formed from a cross bar 156 molded to the collar 158 on handle assembly 14. Stiffening ribs 160, 160 are formed between the collar 158 and the cross bar 156 to add rigidity to the molded assembly.

As best shown in FIG. 13, a fixed jaw 162 is integrally molded to collar 158. The fixed jaw 162 extends most of the width of the cross bar 156 to engage the bottom terminus 154 of a flexible bag 18 along the side of the flexible bag 18 adjacent the handle assembly 14. The bottom retaining assembly 150 also includes the bottom retaining clip 164, which, as best shown in FIG. 14, is substantially U-shaped in cross-section and is constructed and arranged to slidingly engage the cross bar 156. The bottom retaining clip 164 contains a moveable jaw 166 which, in cooperation with the fixed jaw 162, retains the lower terminus 154 of the flexible dust bag 18 in the bottom retaining assembly 150. The bottom retaining clip 164 remains fastened to the cross bar 156 by a slide and pin arrangement. Specifically, there is a pin 168 extending inwardly at each free end of the bottom retaining clip 164. As the bottom retaining clip 164 is slid downwardly into its assembled position, pin 168 advances down a relief 170 in the vertical wall of a cross bar 156 until pin 168 reaches socket 172. The engagement of pins 168, 168 and sockets 172, 172 retain the bottom retaining clip 164 in the orientation shown in FIG. 13.

The bottom retaining assembly 150 may also incorporate a handle 152 for ease of operation of the vacuum cleaner 10. As shown in FIG. 13, like the fixed jaw 162, the handle 152 can be molded as part of the collar 158. In operation, the operator places his or her fingers within the handle 152 on the collar 158 and can lift the vacuum cleaner 10 in a convenient manner.

The bottom retaining assembly 150, when constructed in accordance with the present invention, will firmly retain the lower terminus 154 of the flexible dust bag 18 on the handle assembly 14 utilizing a construction that can be readily assembled without the use of hardware yet is economical to produce and can easily be changed in the event it is desirous to change the appearance of the vacuum cleaner 10.

Figure 15:
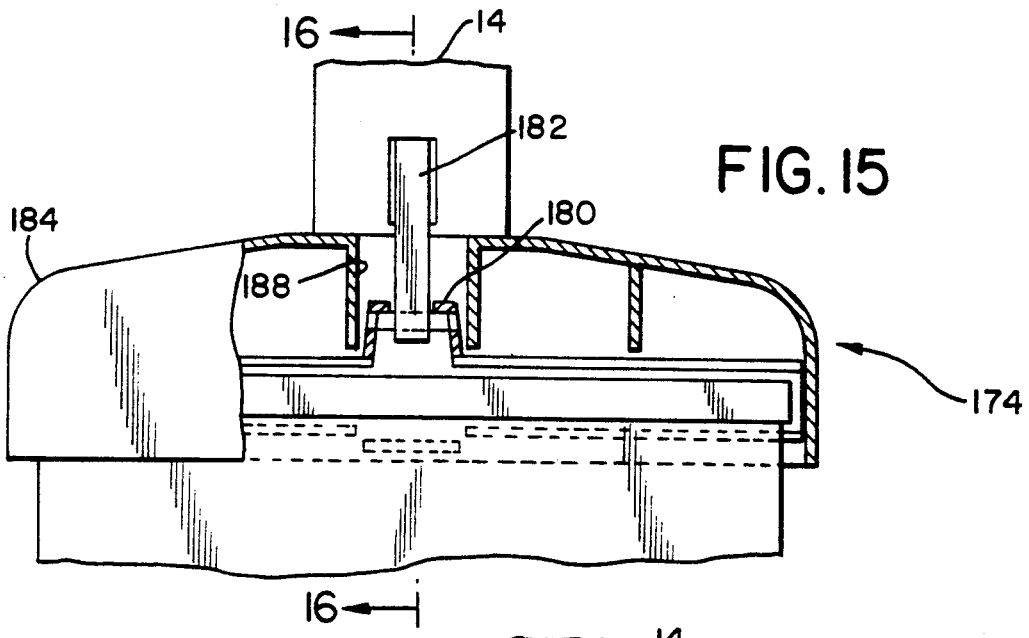
FIG. 15 is a fragmentary front elevation of the upper bag retainer in partial section.
Figure 16:
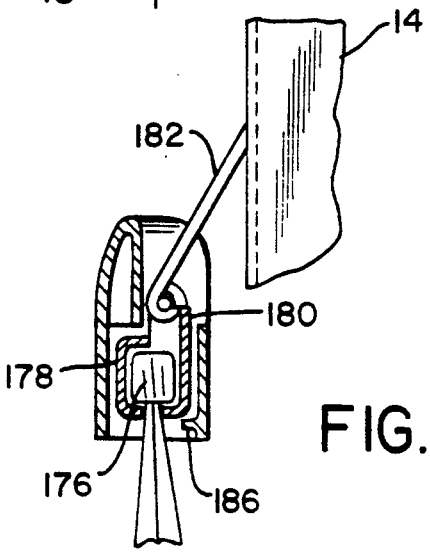
FIG. 16 is a vertical cross-section through the upper bag retainer taken along the line 16—16 in FIG. 15, looking in the direction of the arrows.

The top retaining assembly 174 is shown in FIGS. 15 and 16 and, like the bottom retaining assembly 150, is comprised of a plurality of molded plastic parts which are economical to manufacture, are readily assembled, and can be assembled without the use of tools.

The top retaining assembly 174 retains the upper terminus 176 of the flexible dust bag 18 to the handle assembly 14 in the manner which accommodates the shortening of the flexible dust bag 18 as the bag is caused to inflate by pressurized air from the blower assembly 26 passing through the central conduit 16 and into the inner bag (not shown). The top retaining assembly 174 includes a top retaining channel or clip 178 which is substantially C-shaped in cross-section. The C-shaped top retaining clip 178 is slid around the widened terminus of the upper end of the flexible dust bag 18 which ha been formed therein in the same manner as the lower end as described above. The top retaining clip 178 is slid over the upper terminus 176 of the flexible dust bag 18 with the bag extending downwardly through the open end of the C-shaped cross-section of the top retaining clip 178.

The top retaining clip 178 has a central mount 180. The top retaining assembly 174 is attached to the top of the handle assembly 14 by a tension means 182 such as a flat, pre-stressed spring or solid hook attached to a tension spring (not shown) in the handle assembly 14. The tension means 182 can be removably fastened to the top mount 180 of the top retaining clip 178. When the flexible dust bag 18 inflates, the top retaining assembly 174 moves downwardly causing the tension means 182 to extend.

To improve the aesthetics of the top retaining assembly 174 and to assure that the top retaining clip 178 does not slide off the upper terminus 176 of the flexible dust bag 18, an outer cover 184 is provided. As shown in FIG. 15, the outer cover 184 can be made of molded plastic with appropriate stiffening ribs and can be shaped to be aesthetically pleasing. The outer cover 184 is constructed to slide over the top retaining clip 178. A locking ridge 186 projects from the lower back wall of the outer cover 184. When the outer cover 184 is engaged over the top retaining clip 178, the locking ridge 186 prevents inadvertent removal of the outer cover 184. The outer cover 184 also includes a central clearance 188 which allows the tension means 182 to engage the top retaining clip 178.

Both the top and bottom bag retaining assemblies 174, 150 can be changed to give the vacuum cleaner 10 a different appearance or to distinguish between various levels of trim.

Although the inventions herein have been described with reference to particular embodiments, it is to be understood that these embodiments are merely illustrative of the principals and applications of the inventions. Thus, it is to be understood that numerous modifications may be made in the illustrative embodiments and other arrangements may be devised without department from the spirit and scope of the invention as disclosed and claimed.

What we claim is:

1. An upright vacuum cleaner comprising:

a nozzle assembly;

a blower motor and an output shaft on the motor having an axis of rotation;

means for mounting the blower motor to the nozzle assembly such that the blower motor does not rotate relative to the nozzle assembly;

an impeller housing having integral inner and outer side walls;

means for mounting the impeller housing to the blower motor and the nozzle assembly for rotation relative to the blower motor and the nozzle assembly about an axis concentric to the axis of the motor shaft;

a handle assembly extending from the nozzle assembly; and means on the handle assembly for mounting the handle assembly to the impeller housing whereby the combined impeller housing and handle assembly are rotatable relative to the nozzle assembly about an axis concentric to the axis of the motor shaft.

2. The upright vacuum cleaner of claim 1 further including sealing means separate from the means for mounting the impeller housing to the nozzle assembly for sealing the inner side wall of the impeller housing.

3. The upright vacuum cleaner of claim 2 wherein the sealing means is a seal on the inner side wall of the impeller housing having a diameter smaller than a diameter of the inner side wall of the impeller housing.

4. The upright vacuum cleaner of claim 1 wherein the means for mounting the impeller housing to the blower motor includes:

a motor cover fixedly secured to the impeller housing; and means for rotatably mounting the motor to the motor cover about an axis concentric to the axis of the motor shaft.

5. The upright vacuum cleaner of claim 4 wherein the means for mounting the impeller housing to the nozzle assembly comprises a cylindrical bearing surface on the outside of the impeller housing wherein the cylindrical surface has its axis coaxial to the axis of the motor shaft and a complimentary journal bearing fastened to the nozzle assembly engaging the bearing surface of the impeller housing whereby the impeller housing is rotatable relative to the nozzle assembly about the axis of the cylindrical bearing surface.

6. The upright vacuum cleaner of claim 4 wherein the means for rotatably mounting the motor to the motor cover comprises a shoulder on the motor cover rotatably engaging the motor and a mounting plate on the opposite side of the shoulder journaled to the motor whereby the motor cover rotates relative to the motor and the mounting plate.

7. The upright vacuum cleaner of claim 4 wherein a portion of the motor is mounted within the motor cover and the motor is adjacent a center line of the nozzle assembly.

8. The upright vacuum cleaner of claim 1 further including a cavity between the motor cover and the impeller housing wherein said cavity forms a cooling passage for the blower motor.

9. The upright vacuum cleaner of claim 1 further comprising self-actuating fastening means for retaining the handle assembly to the impeller housing.

10. In an upright vacuum cleaner having a nozzle assembly and a handle assembly rotatably mounted thereto wherein there is a blower assembly including a blower motor fixedly mounted to the nozzle assembly and an impeller housing mounted in the nozzle assembly for rotation relative to the motor and a handle assembly mounted to the impeller housing the improvement comprising:

means for sealing the impeller housing between the motor and the impeller housing; and a means in the nozzle assembly separate from the sealing means for supporting the rotatable impeller housing in the nozzle assembly.

11. The improved upright vacuum cleaner of claim 10 wherein the means for rotatably supporting the impeller housing comprises a bearing surface on the impeller housing and a journal bearing mounted to the nozzle assembly.

* * * * *